US011925225B2

(12) United States Patent
Arnold et al.

(10) Patent No.: US 11,925,225 B2
(45) Date of Patent: Mar. 12, 2024

(54) MICRO HOOK-AND-LOOP CLOSURE SYSTEM

(71) Applicant: NIKE, Inc., Beaverton, OR (US)

(72) Inventors: Jacob R. Arnold, Portland, OR (US); Raj C. Mistry, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 168 days.

(21) Appl. No.: 17/368,022

(22) Filed: Jul. 6, 2021

(65) Prior Publication Data

US 2021/0330009 A1 Oct. 28, 2021

Related U.S. Application Data

(62) Division of application No. 16/354,397, filed on Mar. 15, 2019, now Pat. No. 11,096,437.
(Continued)

(51) Int. Cl.
*A41D 27/28* (2006.01)
*A41B 7/02* (2006.01)
(Continued)

(52) U.S. Cl.
CPC ..... *A41D 27/285* (2013.01); *A41B 7/02* (2013.01); *A41D 17/02* (2013.01); *A41D 27/10* (2013.01);
(Continued)

(58) Field of Classification Search
CPC .... A41B 7/02; A41B 2300/32; A41D 15/002; A41D 17/005; A41D 17/02;
(Continued)

(56) References Cited

U.S. PATENT DOCUMENTS 2,421,848 A * 6/1947 Philipps ..... A41D 19/0041 2/270
3,538,914 A 11/1970 Myers
(Continued)

FOREIGN PATENT DOCUMENTS

CN 201044610 Y 4/2008
CN 201947945 U 8/2011
(Continued)

OTHER PUBLICATIONS

Office Action received for European Patent Application No. 19722230.0, dated Mar. 22, 2022, 4 pages.
(Continued)

*Primary Examiner* — Sally Haden
(74) *Attorney, Agent, or Firm* — Shook, Hardy & Bacon L.L.P.

(57) ABSTRACT

An article or garment comprising a micro hook-and-loop closure system is provided herein. The article comprises at least one extremity-covering portion. The distal end of the extremity-covering portion comprises a first textile at an outer-facing surface and a second textile at an inner-facing surface. The second textile includes micro hook or micro loop materials that releasably mate with complementary micro hook or micro loop materials of the first textile in order to place the micro hook-and-loop closure system in a closed configuration. The placement, size, and shape of each of the first and second textiles, as extending from a distal end toward a proximal end of the article, enable the article or garment to be expediently and comfortably donned and doffed.

10 Claims, 13 Drawing Sheets

Related U.S. Application Data

(60) Provisional application No. 62/677,340, filed on May 29, 2018.

(51) Int. Cl.
*A41D 17/02* (2006.01)
*A41D 27/10* (2006.01)

(52) U.S. Cl.
CPC ..... *A41D 2300/32* (2013.01); *A41D 2400/44* (2013.01); *A41D 2400/70* (2013.01)

(58) Field of Classification Search
CPC ..... A41D 19/0041; A41D 19/0044; A41D 19/0048; A41D 27/285; A41D 2300/32
See application file for complete search history.

(56) References Cited

U.S. PATENT DOCUMENTS 3,889,297 A * 6/1975 Jarboe ..... A41D 13/0005 2/270
4,051,572 A 10/1977 Greenwood
4,055,174 A 10/1977 Levasseur
4,585,003 A 4/1986 Meistrell
4,644,589 A 2/1987 Pettis
4,651,353 A 3/1987 Walden
4,914,756 A 4/1990 Grassick
4,985,936 A 1/1991 Jones
5,008,962 A 4/1991 Smith et al.
5,073,988 A * 12/1991 Lewis, Jr. ..... A41D 19/0041 2/270
5,084,914 A 2/1992 Hesch
5,097,535 A 3/1992 Dye et al.
5,173,967 A 12/1992 Carter
5,191,659 A 3/1993 Backus
5,315,716 A 5/1994 Baum
5,546,608 A 8/1996 Russano
5,924,133 A 7/1999 Zapiti
6,014,777 A 1/2000 Gupton
6,115,948 A 9/2000 Mitchell
6,301,755 B1 10/2001 Gaber
6,477,788 B1 11/2002 Chen
7,152,283 B2 12/2006 Murayama et al.
7,207,195 B2 4/2007 Okawa
8,039,083 B2 10/2011 Higashinaka et al.
8,839,464 B2 9/2014 French
9,476,675 B1 10/2016 Manglos
9,615,614 B2 4/2017 Lamper
2002/0112276 A1 8/2002 Ruman et al.
2006/0293639 A1 12/2006 Van et al.
2007/0143905 A1 6/2007 Mcclelland
2008/0047044 A1 2/2008 Jones
2008/0092273 A1 4/2008 Marshall
2009/0124163 A1 5/2009 Dean
2010/0313388 A1 12/2010 Chou
2011/0047670 A1* 3/2011 Anderson ..... A63B 71/143 2/163
2011/0271497 A1 11/2011 Suh et al.
2012/0030855 A1* 2/2012 Clark ..... A41F 1/06 2/161.1
2012/0096690 A1 4/2012 Chou
2013/0283498 A1* 10/2013 Hewitt ..... A41D 19/0048 2/163
2013/0305570 A1 11/2013 Blake
2015/0135394 A1 5/2015 Bracken
2015/0150318 A1 6/2015 Terrell
2015/0157074 A1 6/2015 Trapani
2015/0245676 A1 9/2015 Carryl et al.
2016/0007665 A1 1/2016 Austin
2016/0345688 A1* 12/2016 Chou ..... A44B 18/0023
2017/0065006 A1 3/2017 Berns
2017/0181504 A1 6/2017 Karni
2017/0202286 A1 7/2017 Cowan et al.
2017/0312615 A1* 11/2017 Matsumoto ..... A41D 19/0048
2019/0328059 A1* 10/2019 Chang ..... A41D 13/08
2019/0364993 A1 12/2019 Arnold et al.

FOREIGN PATENT DOCUMENTS

CN 202135749 U 2/2012
CN 104705822 A 6/2015
GB 2431563 B 4/2010
JP 5709566 B2 3/2015
WO 80/00527 A1 4/1980
WO 2009/000009 A1 12/2008

OTHER PUBLICATIONS

Office Action received for European Patent Application No. 19722230.0, dated Nov. 22, 2021, 5 pages.
Intention to Grant received for European Patent Application No. 19722230.0, dated Mar. 13, 2023, 7 pages.

* cited by examiner

MICRO HOOK-AND-LOOP CLOSURE SYSTEM

CROSS-REFERENCE TO RELATED APPLICATION

This patent application, entitled "Micro Hook-and-Loop Closure System," is a divisional of U.S. application Ser. No. 16/354,397, filed on 15 Mar. 2019 and entitled "Micro Hook-and-Loop Closure System," which claims the benefit of and priority to U.S. Prov. App. No. 62/677,340, filed on 29 May 2018 and entitled "Micro Hook-and-Loop Closure System," which are each incorporated herein by reference in their entirety.

TECHNICAL FIELD

The present invention relates to a micro hook-and-loop closure system for an article or garment.

BACKGROUND

Generally, conventional garments may be difficult to don or doff quickly due to inherent constrictions of garments, such as the narrowing of sleeves near the cuff and the narrowing of pant legs near the hem. Conventional fasteners, such as a button, a zipper, or a metal snap, placed at the cuff of a sleeve or pant leg, only allow expansion of the circumference of the cuff opening by a fixed amount.

BRIEF DESCRIPTION OF THE DRAWINGS

The present aspects are described in detail below with reference to the attached drawing figures, wherein.

DETAILED DESCRIPTION

Figure 1:
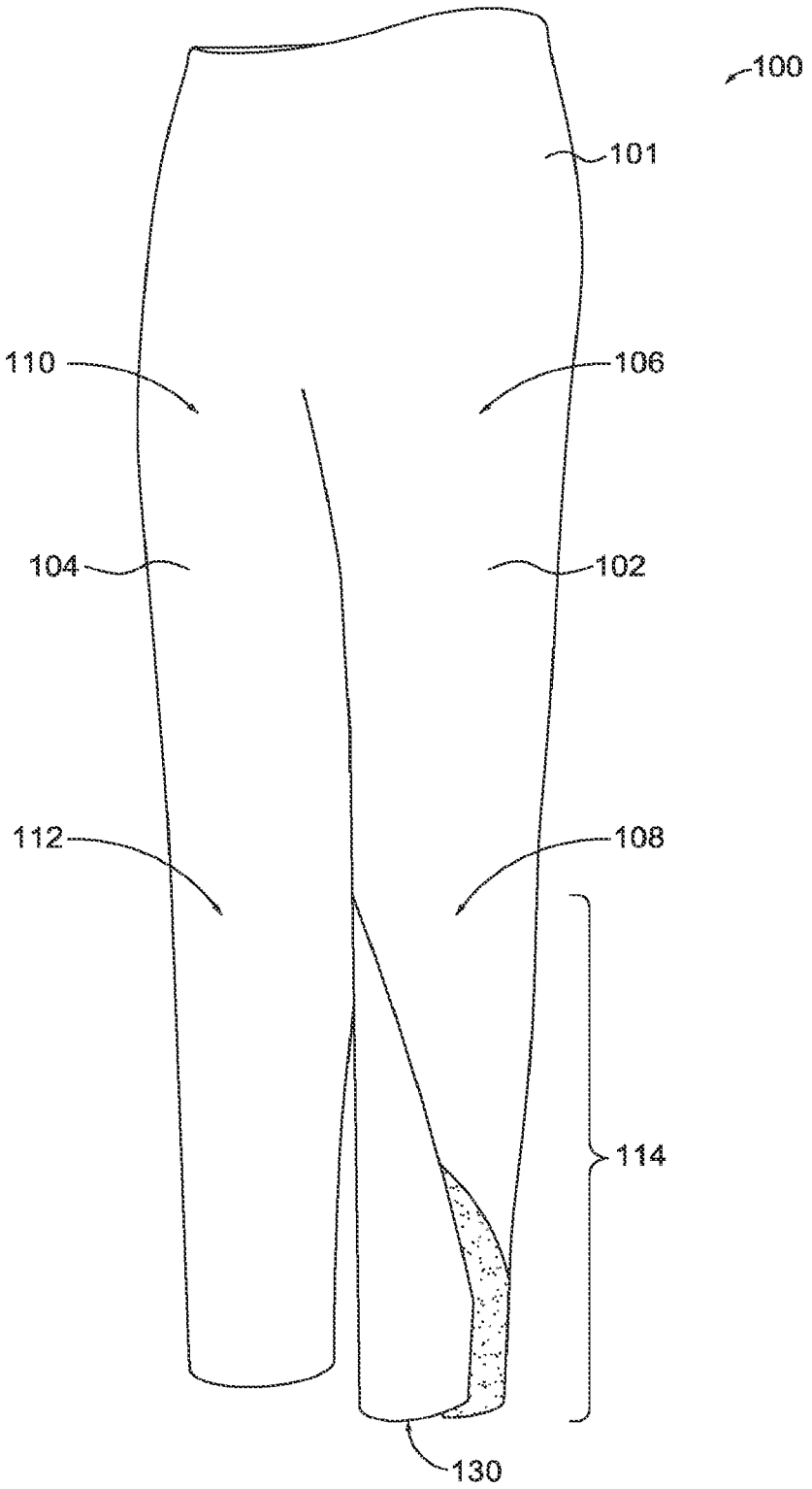
FIG. 1 depicts a perspective view of a lower-torso garment having at least one micro hook-and-loop closure system, in accordance with an aspect herein.

The subject matter of the present disclosure is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Aspects herein are directed to a micro hook-and-loop closure system for use in various articles or garments. In example aspects, the micro hook-and-loop closure system may be used in articles or garments to improve the speed in which the article or garment may be donned and doffed. In some aspects, the micro hook-and-loop closure system is located at extremity-covering portions of a garment. For example, a micro hook-and-loop closure system may be placed at one or more sleeves of an upper-body garment or at one or more legs of a lower-torso garment. The micro hook-and-loop closure systems may be located distally (e.g., at or adjacent to a cuff edge) at an extremity-covering portion of a garment. By placing a micro hook-and-loop closure system at the distal portion of an extremity-covering portion of a garment, the micro hook-and-loop closure system may be opened to enlarge constrictions or narrowed portions that are commonly present at the distal portions of an extremity-covering portion of a garment. For example, sleeves form a distally located opening through which a wearer's hand will be received when an extremity (e.g., an arm) is inserted into the sleeve and the garment is donned. In another example, pant legs form a distally located opening through which a wearer's foot will be received when an extremity (e.g., a leg) is inserted into the pant leg and the garment is donned.

By enlarging the interior and/or opening of a distal portion of an extremity-covering portion of a garment, there is more 'room' available within the extremity-covering portion of the garment for a wearer to quickly insert an extremity (e.g., an arm or leg), into a sleeve or pant leg, for instance. Similarly, by enlarging and/or opening up a distal portion of an extremity-covering portion of a garment, there is more room for a wearer to quickly remove an extremity, such as an arm or leg, out from a sleeve or pant leg, for instance. Thus, garments may also be doffed quickly, for instance, without a wearer's foot catching on the distal portion of a pant leg or without a wearer's thumb catching on a narrow cuff of a sleeve. And, by enlarging the interior and/or opening of a distal portion of an extremity-covering portion, the micro hook-and-loop closure system prevents the bunching and twisting of the garment that commonly occurs at or near constricted portions in the garment, when a wearer dons or doffs the garment.

The micro hook-and-loop closure system enlarges the interior and/or opens up a distal portion of an extremity-covering portion of a garment by un-engaging mated complementary textiles having micro hooks or micro loops over an area that at least extends from a distal portion toward a proximal portion of a garment's extremity-covering portion. Generally, the complementary textiles having micro hooks or micro loops, as discussed in detail hereinafter regarding the closure system, are not arranged in a narrow strip that merely follows the circumference of an opening of a sleeve or pant leg, as might be found in conventional garments. Additionally, because the micro hook-and-loop closure system employs specific placement and arrangement of the textiles comprising micro hook or micro loop materials, as discussed in detail hereinafter, the micro hook and micro loop materials provide a customizable fit of a garment's extremity-covering portions at multiple areas of a distal portion, extending toward a proximal end of the extremity-covering portion. In contrast, a narrow strip of fasteners, as might be found in conventional garments, only allows the most distal point of a sleeve, for example, to be opened or closed.

The micro hook-and-loop closure system described herein is soft and wearable, unlike commonplace macro fasteners (e.g., buttons, metal snaps, conventional or 'macro' hook-and-loop fasteners). The touch and feel of the micro hook-and-loop closure system is soft, as might be found in a fleece-type fabric. The softness of the micro hook-and-loop materials used in the closure system does not irritate or abrade the skin of the wearer when the micro hook-and-loop materials contact the skin of the wearer, unlike conventional macro hook-and-loop fasteners. Accordingly, as skin contact with the micro hook-and-loop materials is unexpectedly not irritating, the placement of the micro hook-and-loop materials in a garment is not restricted. For example, the micro hook-and-loop materials in the garment may be placed in areas where contact with the skin of a wear is likely because the micro hook-and-loop materials generally do not irritate the skin. In contrast, the placement of conventional macro hook-and-loop fasteners in garments is purposefully limited to areas where the skin of a wearer does contact the macro hook-and-loop fasteners, or is associated with limited skin contact, with the conventional macro hook-and-loop fasteners. Moreover, due to the potential skin irritant of conventional macro hook-and-loop fasteners, conventional macro hoop-and-loop fasteners are also arranged in garments so that the fasteners are perfectly aligned when mated to one another and completely overlap one another, leaving none of the macro hook-and-loop fasteners exposed for potential skin contact.

Arrangements that produce perfect alignment and complete overlap of conventional macro hook-and loop materials is also implemented because conventional macro hook-and-loop materials may catch and snag other materials in the garment, causing damage and unnecessary wear-and-tear to the garment. In contrast, the micro hook-and-loop closure system does not catch or snag other materials when the fasteners of the micro hook-and-loop materials come in contact with other materials. As such, perfect alignment and/or complete overlap of the micro hook-and-loop materials is not necessary such that the micro hook-and-loop closure system allows multiple degrees of contact between the micro hooks and micro loops, creating an adjustable fit and progressive tightening of garment portions.

As used herein, the term "micro hook-and-loop materials" encompasses a micro hook or micro hook material that is configured to releasably mate with a complementary micro hook or micro loop material. The term "releasably mate," as used herein, refers to a fastener's capability of being mated and disengaged (e.g., affixed and un-affixed) many times over. Accordingly, releasably mate-able fasteners, such as micro hook-and-loop materials, may be mated and disengaged time and time again while retaining fastening ability. In some aspects, micro loop material comprises micro-fibriform loop structures and micro hook material comprises micro-fibriform pile structures. In aspects herein, the micro hook-and-loop closure system includes materials constructed using polyester, polypropylene, and/or nylon, though these examples are not limiting. In one aspect, the micro loop material is about 10 denier or less. Additionally, in one aspect, the micro hook material is about 10 denier. Denier is a measurement of the mass density of fibers in the textile arts, generally defined as the linear mass density of the fibers (e.g., n gram(s) per n meter(s) of a fiber). For example, a fiber with a mass of one gram per 9000 meters exhibits a denier of 0.11 mg/m. The micro loop material exhibits a range of from about 1 to about 0.05 or less denier, in some aspects (as used herein, the term "about" means within ±10% of a given value). In some aspects, the micro hook material exhibits a range of from about 5 to about 1 or less denier. These denier characteristics of the micro loop material and/or the characteristics of the micro hook material provide the soft touch qualities and snag reduction discussed hereinabove. In one example aspect, the micro loop material has a fiber size of about 1 denier, a fiber diameter of about 3 microns, a fiber cross-section of about 8 square microns, and a density of about 1 million fibers per square inch. The micro hook material has a fiber size of about 3 denier, a fiber diameter of about 10 microns, a fiber cross-section of about 80 square microns, and a density of about 90,000 fibers per square inch, in one example aspect. These characteristics of the micro loop material and/or the characteristics of the micro hook material, whether alone or in various combinations, provide the soft touch qualities and snag reduction discussed hereinabove. In contrast to the micro hook-and-loop closure system, macro loop fasteners generally have a measurement of about 20 denier, a fiber diameter of about 45 microns, a fiber cross-section of about 1500 square microns, and/or a density of about 13,000 fibers per square inch. Further, in contrast to the micro hook-and-loop closure system, macro hook fasteners have a measurement of about 325 denier, a fiber diameter of about 175 microns, a fiber cross-section of about 25,000 square microns, and/or a density of about 350 fibers per square inch.

It will be understood that, generally, directional descriptions used herein, such as left or right, front or back, up or down, and proximal or distal, are used relative to basic anatomical convention (i.e., a wearer standing in an upright position) in order to provide consistency and alleviate confusion in the description of the system when shown from the various vantage points provided in the figures herein. As an example, directional descriptions are used with respect to the garment being in an as-worn configuration with the wearer standing in the anatomical position. It is also understood that garments described herein are meant to be worn in conventional ways (e.g., right-side out and the front of the garment being on the front of the wearer) and to be appropriately sized for the wearer. Additionally, it will be understood that the micro hook-and-loop closure system may be used with relation to other garments and the examples provided by the figures herein are merely illustrative in nature. As used herein, the term "contact area" refers to the surface area of a textile as calculated based on the textile's macro geometry (e.g., length, width, and shape of the textile). The "contact area" does not refer to the surface area as would be calculated to include the additional surface area created by the presence of the individual micro hooks and micro loops.

In one aspect, a garment is provided. The garment comprises at least one extremity-covering portion having a proximal end, a distal end, an inner-facing surface, and an outer-facing surface. The distal end of the extremity-covering portion comprises a first free fabric edge extending towards the proximal end of the extremity-covering portion and a second free fabric edge extending towards the proximal end of the extremity-covering portion, in aspects. The distal end of the extremity-covering portion further comprises, in one aspect, a first textile comprising one of a micro hook material or a micro loop material located on the outer-facing surface of the distal end of the extremity-covering portion adjacent to the first free fabric edge. In an aspect, the distal end of the extremity-covering portion comprises a second textile comprising one of a micro hook material or a micro loop material complementary to the micro hook material or the micro loop material of the first textile, the second textile located on the inner-facing surface of the distal end of the extremity-covering portion adjacent to the second free fabric edge.

In another aspect, a lower-torso garment is provided. The lower-torso garment comprises at least one pant leg having a proximal end, a distal end, an inner-facing surface, and an outer-facing surface. The distal end of the pant leg comprises, in an aspect, a first free fabric edge extending towards the proximal end of the pant leg and a second free fabric edge extending towards the proximal end of the pant leg. In an aspect, the distal end of the pant leg further comprises a first textile comprising one of a micro hook material or a micro loop material. The first textile is located on the outer-facing surface of the distal end of the pant leg adjacent to the first free fabric edge. In a further aspect, the distal end of the pant leg comprises a second textile comprising one of a micro hook material or a micro loop material complementary to the micro hook material or the micro loop material of the first textile. The second textile is located on the inner-facing surface of the distal end of the pant leg adjacent to the second free fabric edge. In aspects, the second textile is configured to releasably mate with at least a portion of the first textile.

In yet another aspect, an upper-body garment is provided. The upper-body garment comprises at least one sleeve having a proximal end, a distal end, an inner-facing surface, and an outer-facing surface. The distal end of the sleeve comprises, in an aspect, a first free fabric edge extending towards the proximal end of the sleeve and a second free fabric edge extending towards the proximal end of the sleeve. In an aspect, the upper-body garment further comprises a first textile comprising one of a micro hook material or a micro loop material. The first textile is located on the outer-facing surface of the distal end of the sleeve adjacent to the first free fabric edge. The upper-body garment comprises, in an aspect, a second textile comprising one of a micro hook material or a micro loop material complementary to the micro hook material or the micro loop material of the first textile. The second textile is located on the inner-facing surface of the distal end of the sleeve adjacent to the second free fabric edge, in aspects. The second textile is configured to releasably mate with at least a portion of the first textile.

Figure 2:
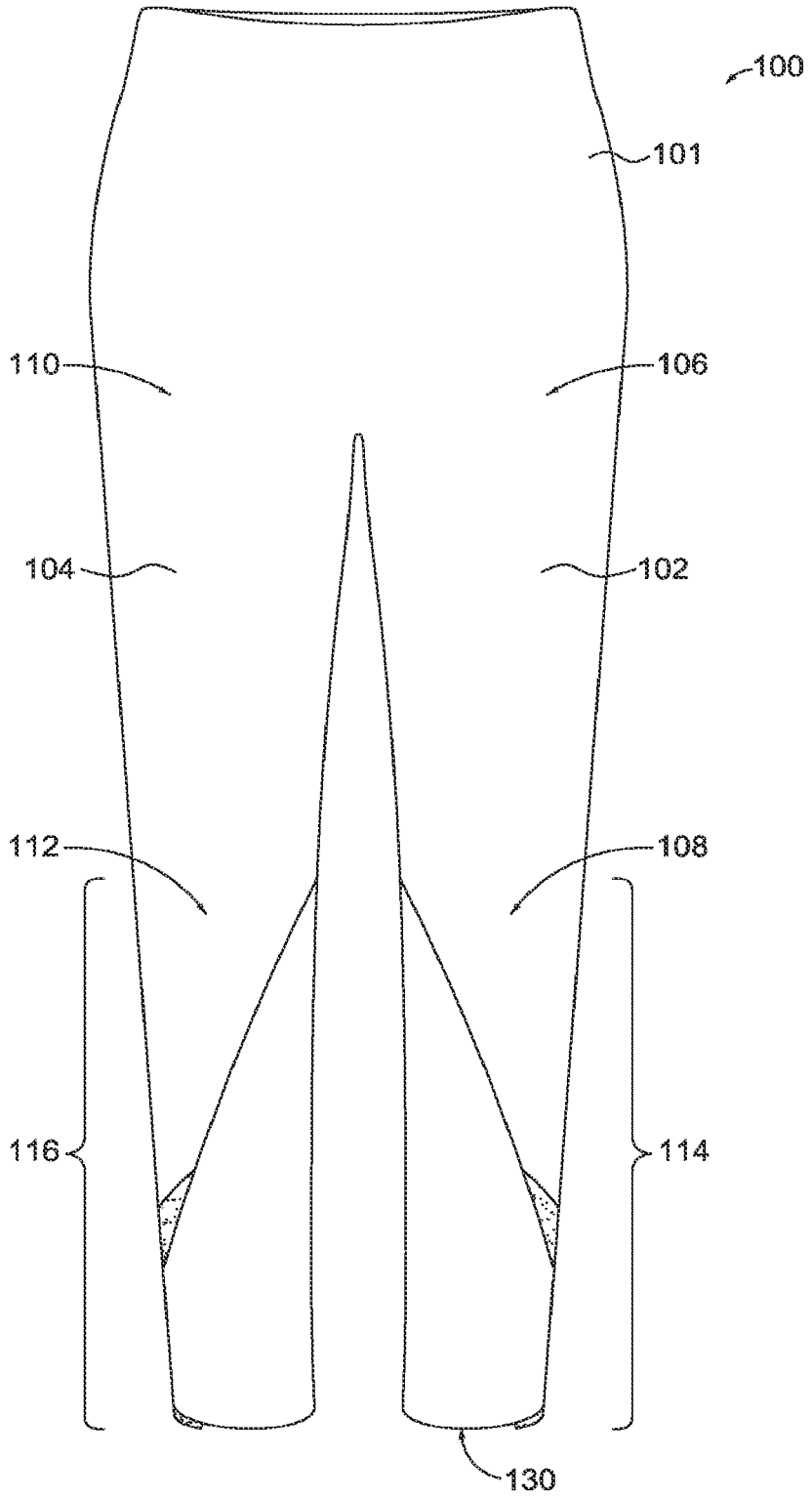
FIG. 2 depicts a front view of the lower-torso garment of FIG. 1, in accordance with an aspect herein.
Figure 3:
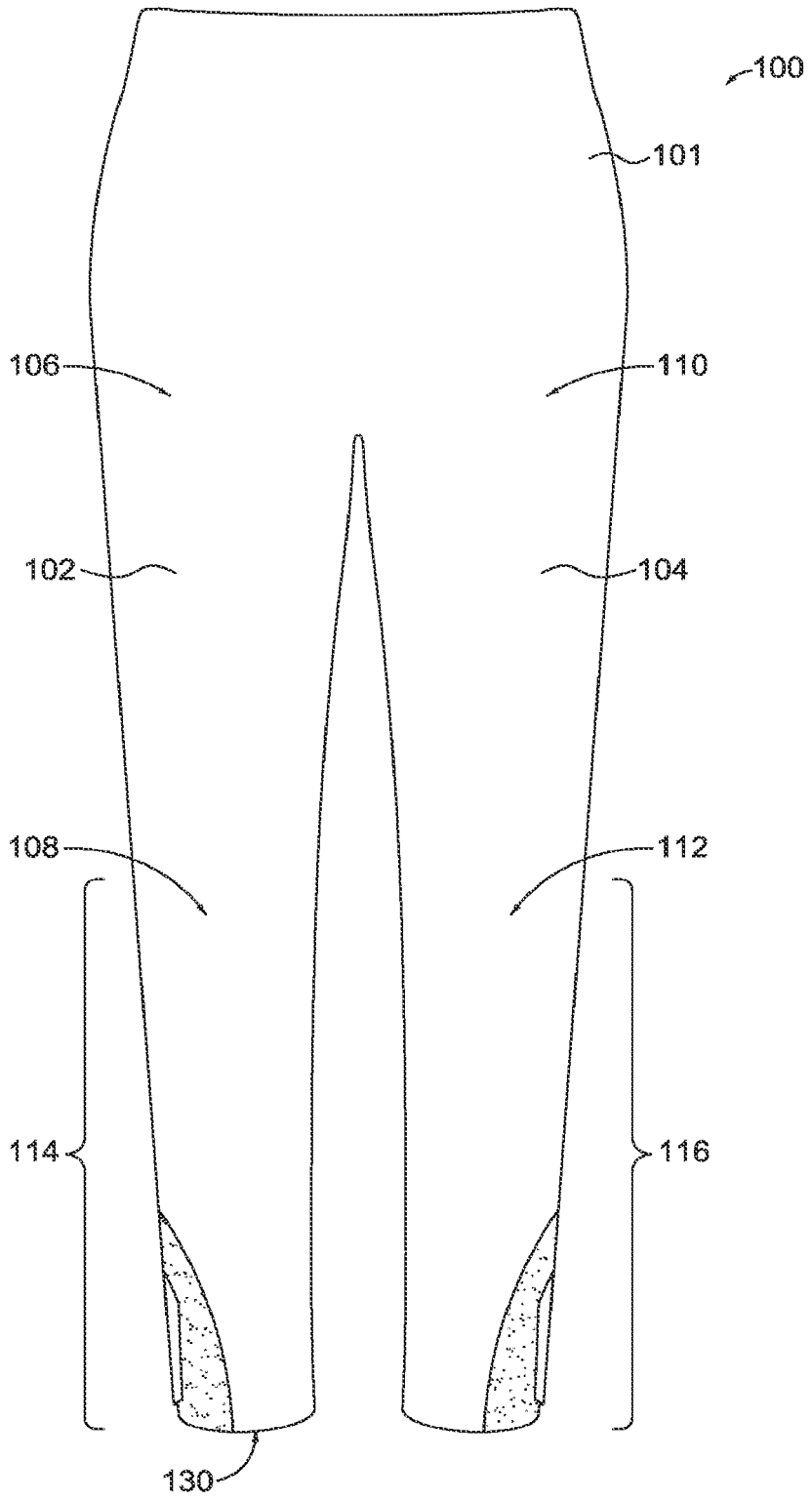
FIG. 3 depicts a rear view of the lower-torso garment of FIG. 1, in accordance with an aspect herein.

Beginning with FIG. 1, a perspective view of an example lower-torso garment 100 having at least one micro hook-and-loop closure system is provided in accordance with aspects herein. FIG. 2 presents a front plan view of the lower-torso garment 100, while FIG. 3 presents a rear plan view of the lower-torso garment 100. In one aspect, the lower-torso garment 100 is a pair of pants, a pair of shorts, a pair of full-length pants, a pair of three-quarter length pants, a pair of sweatpants, a pair of running tights, a pair of yoga-style pants, and the like. The lower-torso garment 100 comprises a body 101 configured to cover a lower torso portion of a wearer's body. A body 101 might comprise one or more fabric panels joined together by one or more seams. In another example aspect, the body 101 may be constructed using a continuous panel of fabric to provide a seamless or nearly seamless garment.

The body 101 of the lower-torso garment 100 comprises two pant legs: a first pant leg 102 and a second pant leg 104. Accordingly, in one aspect, the first pant leg 102 and the second pant leg 104 correspond to opposite sides of the body 101, for example, such as a right side or a left side of the body 101. In some aspects, the first pant leg 102 and the second pant leg 104 correspond to separate halves of the body 101. The first pant leg 102 may sheath or encircle a left leg when the lower-torso garment 100 is in use (e.g., during wear), in one aspect. The second pant leg 104 may sheath or encircle a right leg when the lower-torso garment 100 is in use. It will be understood that the directional terms "left" and "right" are used conventionally herein for simplicity but may be used interchangeable with numerical terms such as "first" and "second," for example. Accordingly, the terms "first" and "second" are used throughout this disclosure for clarity when referencing the figures; however, the terms are not intended to connote any particular sequence, configuration, and/or orientation in a garment and the terms should not be construed as limiting in such a manner.

Continuing with FIG. 1, the first pant leg 102 comprises a proximal end 106 and a distal end 108. The second pant leg 104 comprises a proximal end 110 and a distal end 112 as well. As used herein, the terms "proximal" and "distal" are used in accordance with common anatomical parlance. In aspects, the micro hook-and-loop closure systems 114 and 116 are located at, near, or proximate to the first pant leg 102 distal end 108 and/or the second pant leg 104 distal end 112. Although each pant leg is illustrated as having one micro hook-and-loop closure system, it is contemplated that more than one micro hook-and-loop closure system might be implemented in a pant leg, at any location. In aspects, the micro hook-and-loop closure system 114 may be located anywhere at or within about 10 centimeters (cm) of distal edge 130 of the first and second pant legs 102 and 104. In some aspects, the micro hook-and-loop closure system 114 touches the distal edge 130 of the first pant leg 102. For example, the micro hook-and-loop closure system 114 may extend, beginning at the distal edge 130, for a length of 10 cm, toward the proximal end 106. In another example, the micro hook-and-loop closure system 114 may extend, beginning 2 to 3 cm away from the distal edge 130, for 10 cm toward the proximal end 106. It will be understood that these ranges provides in cm speak, generally, to an adult-sized garment.

Figure 4:
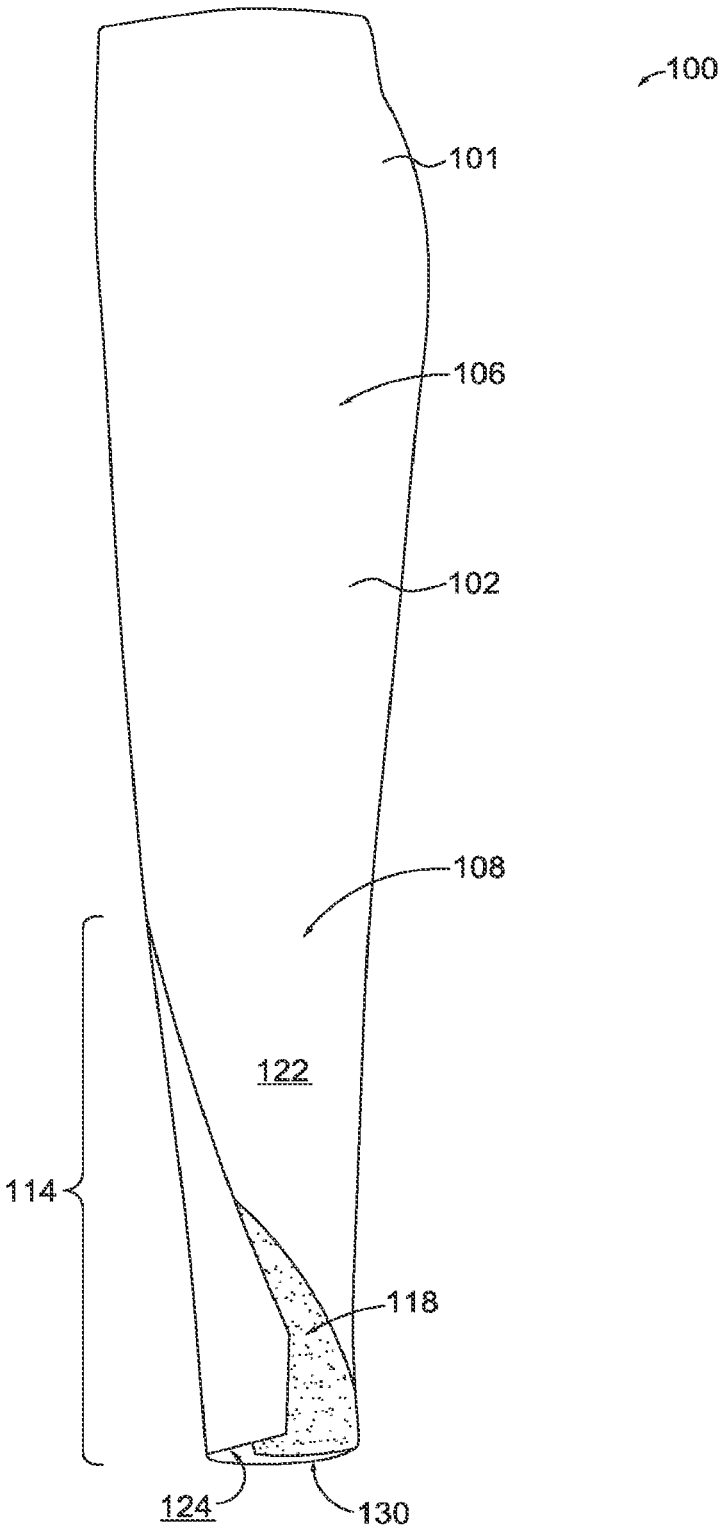
FIG. 4 depicts a side view of the lower-torso garment of FIG. 1, in accordance with an aspect herein.
Figure 5:
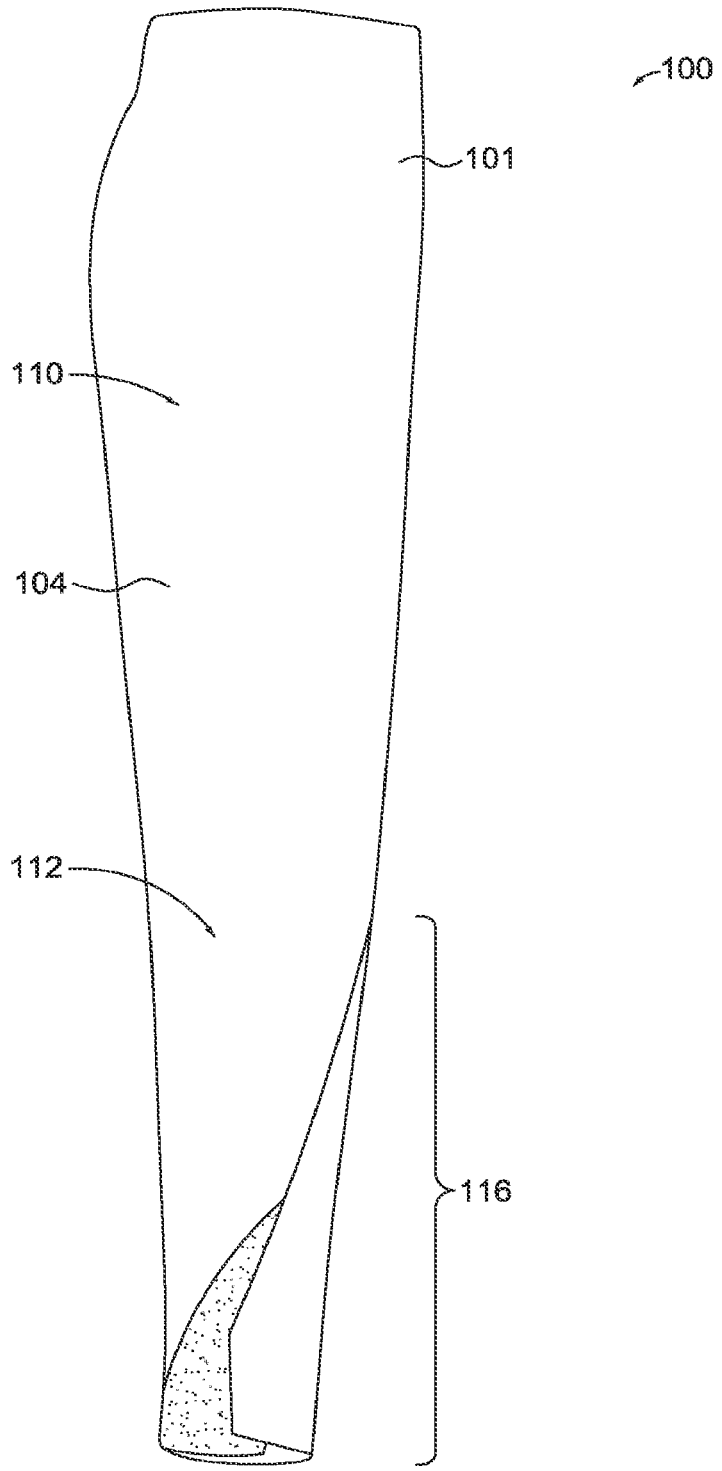
FIG. 5 depicts another side view of the lower-torso garment of FIG. 1, in accordance with an aspect herein.

In some aspects, each of the first pant leg 102 distal end 108 and the second pant leg 104 distal end 112 include a separate micro hook-and-loop closure system. For example, the first pant leg 102 distal end 108 may comprise the micro hook-and-loop closure system 114 while the second pant leg 104 distal end 112 may comprise the micro hook-and-loop closure system 116. The micro hook-and-loop closure system 114 corresponding to the first pant leg 102 is shown in FIG. 4, which presents a side plan view of the lower-torso garment 100. The micro hook-and-loop closure system 116 corresponding to the second pant leg 104 is shown in FIG. 5, which presents a side plan view of the lower-torso garment 100.

The micro hook-and-loop closure systems 114 and 116 comprise a textile of micro hook material and a textile of micro loop material. The micro hook material releasably mates and/or engages the micro loop material, enabling the micro hook-and-loop closure systems 114 and 116 to be closed and opened any number of times. For brevity, the micro hook-and-loop closure system 114 will be discussed in detail and it will be understood that the micro hook-and-loop closure system 116 operates similarly unless express differences are discussed hereinafter. Accordingly, although the discussion that follows focuses on an individual sleeve or one pant leg (e.g., the first pant leg 102) in particular, it will be understood that the discussion is also applicable to another sleeve or another pant leg (e.g., the second pant leg 104), except where expressly noted otherwise.

Figure 6:
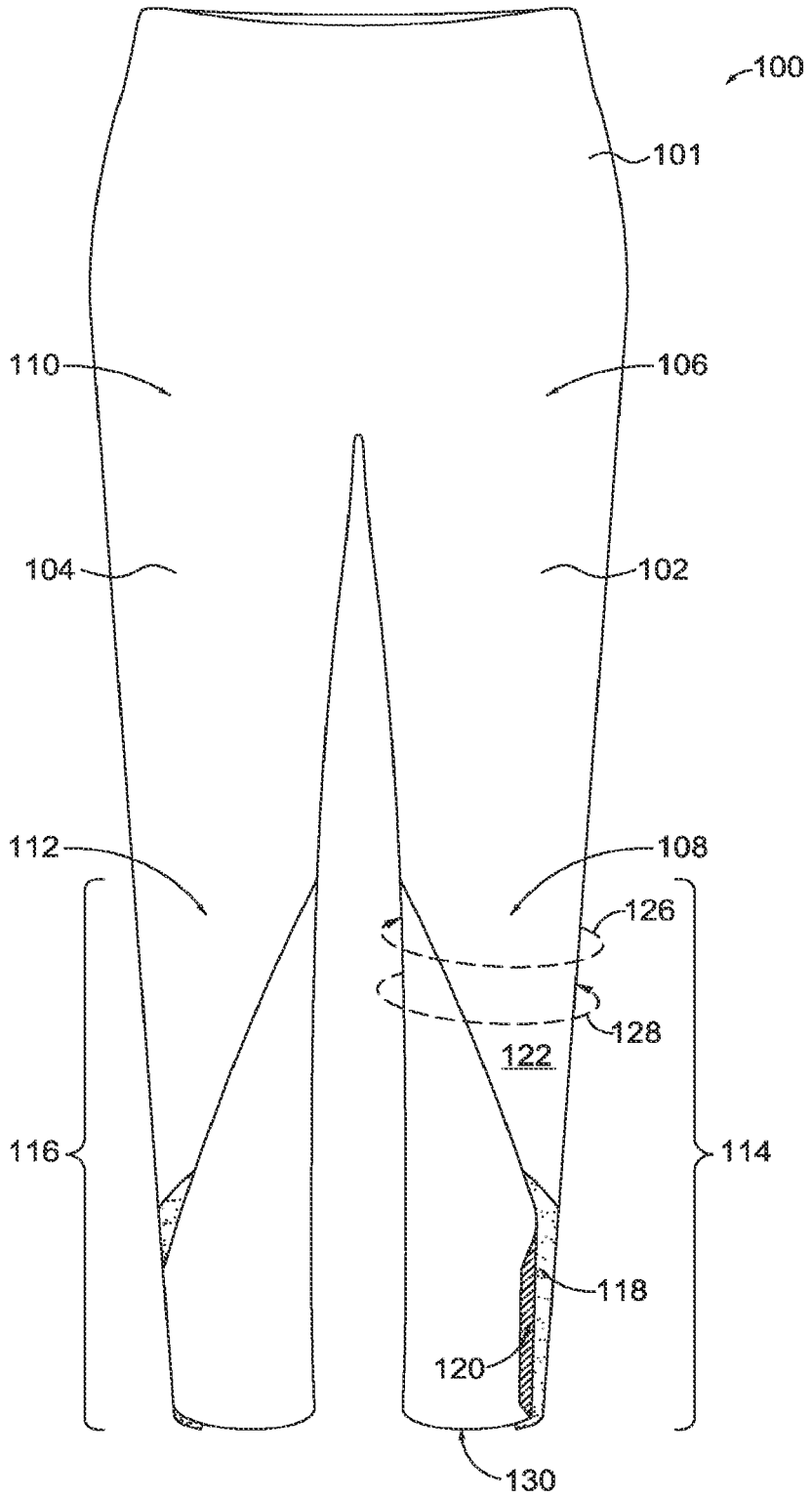
FIG. 6 depicts a front view of the lower-torso garment of FIG. 1, in accordance with an aspect herein.
Figure 7:
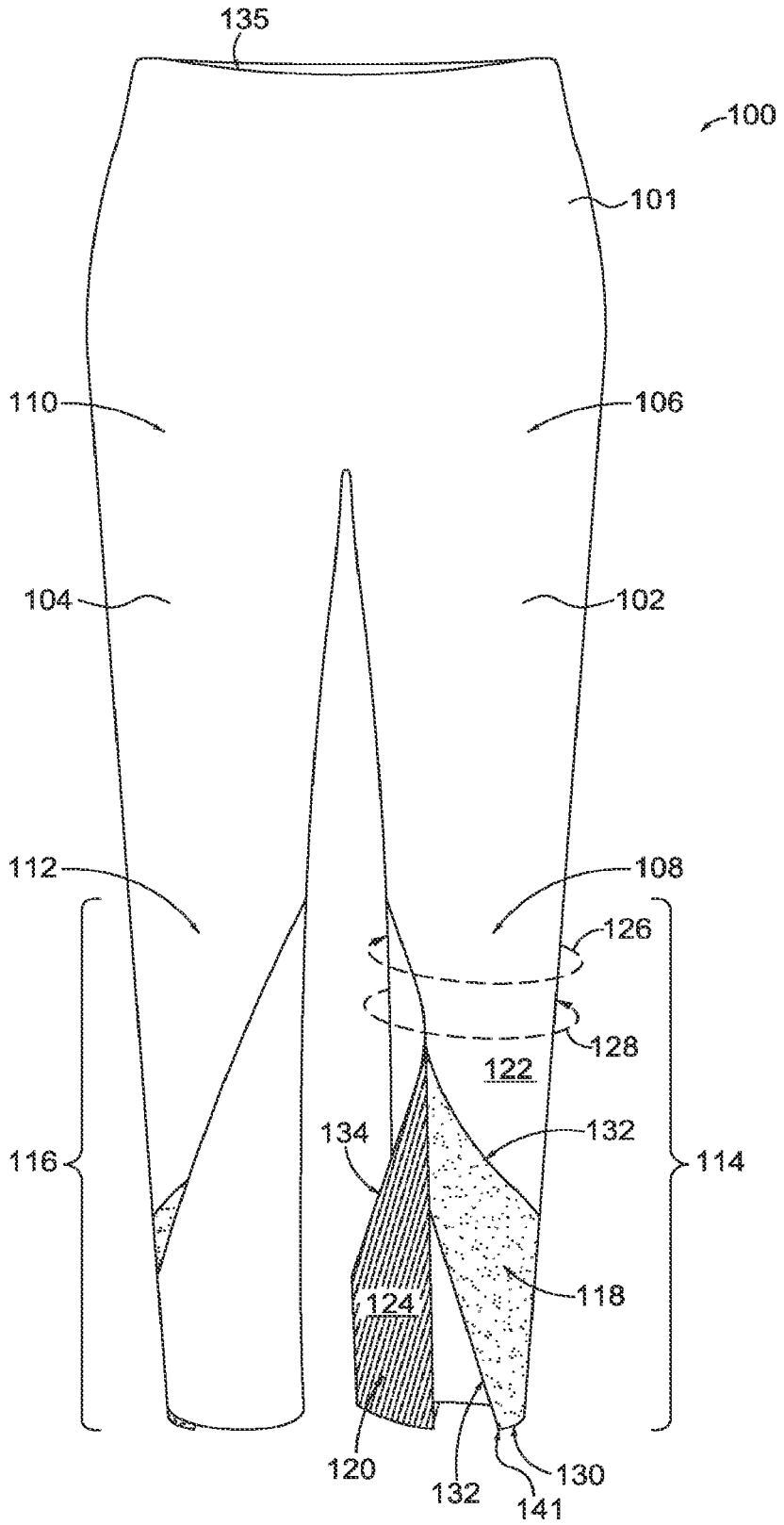
FIG. 7 depicts a front view of the lower-torso garment of FIG. 1, with one of the micro hook-and-loop closure systems being shown in a first in-use configuration, in accordance with an aspect herein.

In an aspect, the micro hook-and-loop closure system 114 of the first pant leg 102 comprises a first textile 118 (e.g., FIGS. 4 and 6) and a second textile 120 (e.g., FIGS. 6 and 7). The first textile 118 comprises one of a micro hook material or a micro loop material. The second textile 120 comprises one of a micro hook material or a micro loop material that is complementary to the micro hook material or the micro loop material of the first textile 118. In one aspect, the first textile 118 is located on an outer-facing surface 122 of the first pant leg 102 distal end 108. In one such aspect, the second textile 120 is located on an inner-facing surface 124 of the first pant leg 102 distal end 108, as shown in FIG. 7. As used herein, "outer-facing" and "inner-facing" refer to the orientation of the garment's surface when a garment is worn in a conventional way (e.g., right-side out and the front of the garment being on the front of the wearer) and when the micro hook-and-loop closure system 114 is in a closed state. For example, as shown in FIG. 2, the first textile 118 is located at the outer-facing surface 122 and the micro hook-and-loop closure system 114 is depicted in a closed state. In FIG. 6, the micro hook-and-loop closure system 114 is depicted as transitioning from the closed state to an open state, as the contact between coupled hook-and-loop fasteners is broken by pulling one textile (e.g., second textile 120) away from the other (e.g., first textile 118). In FIG. 7, the second textile 120 is located on the inner-facing surface 124 and the micro hook-and-loop closure system 114 is shown in an open state. Hereinafter, an open state will be referred to as a first in-use configuration and a closed state will be referred to as a second in-use configuration.

When the micro hook-and-loop closure system 114 is in the second in-use configuration, the first textile 118 located at or on the outer-facing surface 122 of the first pant leg 102 releasably mates and/or engages the second textile 120 located on the inner-facing surface 124 of the first pant leg 102. FIGS. 2 through 5 provide views of the micro hook-and-loop closure system 114 in the second in-use configuration, for example. The mating or engagement is achieved by placing the second textile 120 in physical contact with the first textile 118. In one aspect, at least a portion of the second textile 120 located on the inner-facing surface 124 is placed over, or placed on top of, at least a portion of the first textile 118 located at the outer-facing surface 122, and the contact between the micro hook material and complementary micro loop material holds the second textile 120 and the first textile 118 to one another at one or more locations of contact. In this way, a least a portion of the first textile 118 and at least a portion of the second textile 120 releasably mate with one another.

In some aspects, the first textile 118 and the second textile 120 of the micro hook-and-loop closure system 114 are arranged such that the micro hook-and-loop closure system 114 provides a wrap-type of closure at the first pant leg 102 distal end 108. Aspects of such an arrangement are visible in the front plan view of FIG. 2, the rear plan view of FIG. 3, and the side plan views of FIGS. 4 and 5, which illustrate the example placement of the first textile 118 and second textile 120 when the garment is worn in a conventional way. For example, as visible in FIG. 6, the second textile 120 may be pulled away from the first textile 118 in a first direction 126 (e.g., from back of the first pant leg 102, around the side of the first pant leg 102, and toward the front of the first pant leg 102) to separate the first and second textiles 118 and 120 from one another, thus transitioning the micro hook-and-loop closure system 114 into the first in-use configuration (i.e., open state). The second textile 120 may be pulled in a second direction 128 (e.g., from the front of the first pant leg 102 around the side of the first pant leg 102 toward the back of the first pant leg 102) and placed in contact with the first textile 118 to transition the micro hook-and-loop closure system 114 to the second in-use configuration (i.e., closed state). In such an aspect, the first pant leg 102 micro hook-and-loop closure system 114 may be opened in a clockwise direction and closed in a counter-clockwise direction, relative to the first pant leg 102 distal end 108.

The arrangement of the first textile 118 and the second textile 120 in the micro hook-and-loop closure system 114 provides variable degrees of contact between the first textile 118 and the second textile 120 when in the second in-use configuration. For example, by increasing the size of the area that the first textile 118 contacts the second textile 120 at the distal end 108 in the second in-use configuration, the circumference of the first pant leg 102 at the distal end 108 decreases and the fit of the first pant leg 102 at the distal end 108 may be constricted and/or tightened in fit. By decreasing the size of the area that the first textile 118 contacts the second textile 120 at the distal end 108 when in the second in-use configuration, the circumference of the first pant leg 102 at the distal end 108 may be increased and/or the fit of the first pant leg 102 at the distal end 108 is comparatively loosened, for example. Accordingly, the contact and/or overlap between the first textile 118 and the second textile 120, when mated to one another, provides for an adjustable circumference of the first pant leg 102.

In various aspects, the micro hook-and-loop closure system 116 of the second pant leg 104 comprises textiles that are arranged with complementary hook-and-loop materials, similar to the first pant leg 102 micro hook-and-loop closure system 114. Thus, the second pant leg 104 micro hook-and-loop closure system 116 also provides a wrap-type of closure at the distal end 112 for an adjustable fit, in aspects. In some aspects, the micro hook-and-loop closure system 116 of the second pant leg 104 is transitioned into the first in-use configuration (i.e., open) by pulling complementary textiles apart from one another in a counter-clockwise direction and is transitioned into the second in-use configuration by placing complementary textiles in contact with one another using a clockwise direction, relative to the second pant leg 104.

Figure 9:
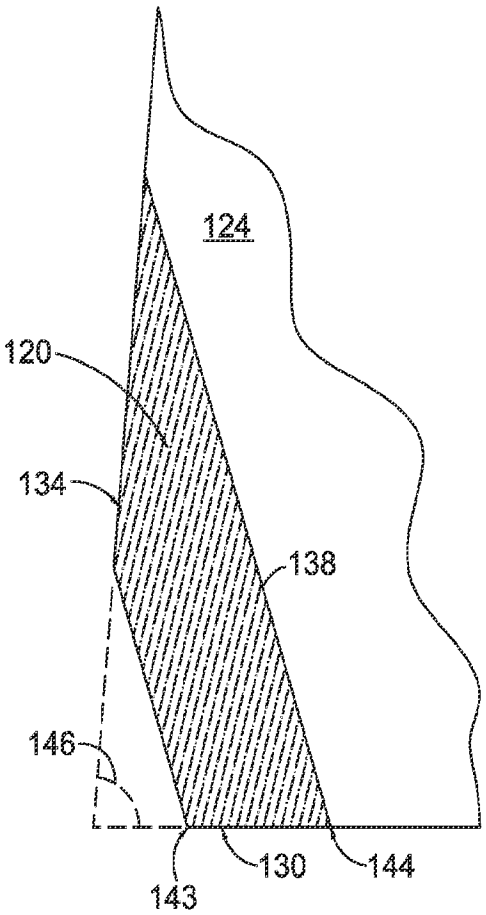
FIG. 9 depicts a plan view of another complementary portion of a micro hook-and-loop closure system of the lower-torso garment of FIG. 1, in accordance with an aspect herein.
Figure 8:
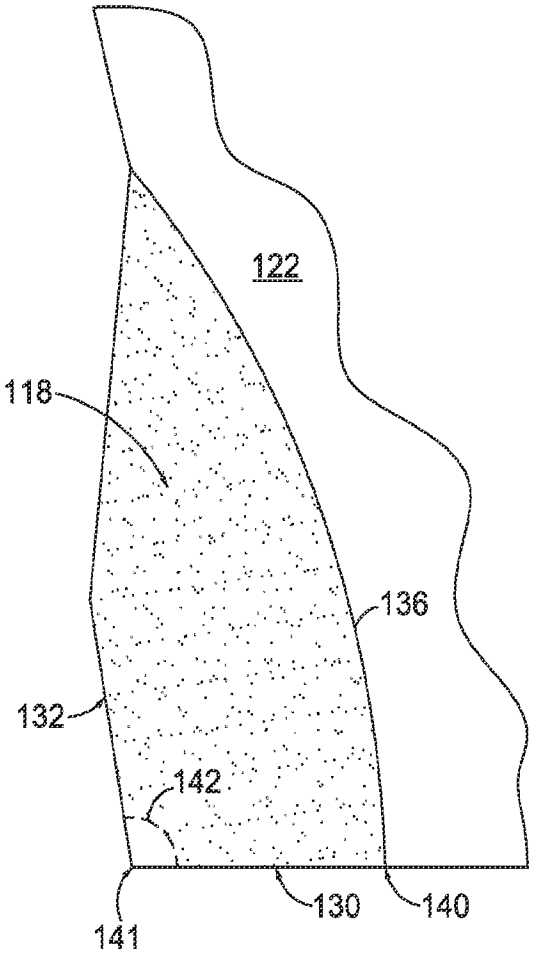
FIG. 8 depicts a plan view of a portion of a micro hook-and-loop closure system of the lower-torso garment of FIG. 1, in accordance with an aspect herein.

FIGS. 8 and 9 provide further detail as to how the micro hook-and-loop closure systems 114 and 116 operate. FIG. 8 presents a plan view of a portion of the outer-facing surface 122 of the first textile 118 of the first pant leg 102. FIG. 9 presents a plan view of a portion of the inner-facing surface 124 of the second textile 120 of the first pant leg 102. The first pant leg 102 distal end 108 has the distal edge 130. The first textile 118 positioned on the outer-facing surface 122 is located adjacent to a first free fabric edge 132 extending from the distal edge 130 toward the proximal end 106 of the first pant leg 102. The second textile 120 located at the inner-facing surface 124 is located adjacent to a second free fabric edge 134 extending from the distal edge toward the proximal end 106 of the first pant leg 102.

With respect to FIG. 8, the first textile 118 extends from a first textile boundary 136 located on the outer-facing surface 122 to the first free fabric edge 132 and, with respect to FIG. 9, the second textile 120 extends from a second textile boundary 138 located on the inner-facing surface 124 to the second free fabric edge 134. The first free fabric edge 132, the first textile boundary 136, the second free fabric edge 134, and the second textile boundary 138 may be any length or shape, and may be straight, curvilinear, zig-zag, and the like. The first free fabric edge 132 and the second free fabric edge 134 may share the same or similar dimensions, or alternatively, may be different in dimension, shape, and/or size. The first textile boundary 136 and the second textile boundary 138 may share the same or similar dimensions in some aspects, or alternatively, may be different in dimension, shape, and/or size. In one specific aspect, the first free fabric edge 132 and the second textile boundary 138 share the same or similar dimensions as extending from the distal edge 130 toward the proximal end 106. In such an aspect, the second free fabric edge 134 and the first textile boundary 136 may also share the same or similar dimensions, as extending from the distal edge 130 toward the proximal end 106. Accordingly, the first textile 118 has a perimeter shape defined by the first free fabric edge 132 and the first textile boundary 136, whereas the second textile 120 has a perimeter shape defined by second free fabric edge 134 and the second textile boundary 138, in aspects.

In one example aspect, the first textile boundary 136 extends from the distal edge 130 to the first free fabric edge 132. The first textile boundary 136 may extend orthogonally from the distal edge 130 and may follow a curvilinear path that extends to the first free fabric edge 132, in one aspect. In other aspects, the first textile boundary 136 may extend non-orthogonally from the distal edge 130 and follow any linear or non-linear path that extends to the first free fabric edge 132. The second textile boundary 138, in various aspects, extends from the distal edge 130 to the second free fabric edge 134. In one aspect, the second textile boundary 138 may extend orthogonally from the distal edge 130 and may follow a curvilinear shape that extends to the second free fabric edge 134. In some aspects, the second textile boundary 138 may extend non-orthogonally from the distal edge 130 and follow any linear or non-linear path that extends to the second free fabric edge 134 such as that shown in FIG. 9.

In various aspects, the respective dimensions, shapes, and/or sizes of the first free fabric edge 132, the first textile boundary 136, the second free fabric edge 134, and the second textile boundary 138 enable the second textile 120 to releasably mate with at least a portion of the first textile 118 when in the second in-use configuration. In one aspect, the perimeter shape (e.g., shape, size, and/or dimensions) of the first textile 118 is the same or similar to the perimeter shape of the second textile 120. Alternatively, the perimeter shape of the first textile 118 may be different than the perimeter shaper of the second textile 120 while still enabling the second in-use configuration.

In some aspects, when measured parallel to the distal edge 130, a width of the first textile 118 measured from the first free fabric edge 132 to the first textile boundary 136 increases as the first textile 118 extends distally toward the distal edge 130. In some aspects, when measured parallel to the distal edge 130, a width of the second textile 120 measured from the second free fabric edge 134 to the second textile boundary 138 increases as the second textile 120 extends distally toward the distal edge 130. Accordingly, in various aspects, the width of the first textile 118 and the width of the second textile 120 are greater nearer the distal edge 130, relative to their respective widths nearer the first pant leg 102 proximal end 106. The changes in width of the first textile 118 and second textile 120 provide a customized fit for a wearer. The amount of contact between the first textile 118 and second textile 120 is simultaneously customizable in more than one direction, for example, in directions both parallel and orthogonal to the distal edge 130. As such, the fit of the lower-torso garment 100 is adjustable from the distal edge 130 extending toward the proximal end 106, due to the dimensions of the area of the first textile 118 that are available for contact with the dimensions of the area of the second textile 120.

The first free fabric edge 132 and the second free fabric edge 134 may extend from the distal edge 130 toward the proximal end 106 for a defined length. For example, the first free fabric edge 132 and/or the second free fabric edge 134 may extend from the distal edge 130 toward the proximal end 106 for a length that is from about one-half to about one-tenth the length of the first pant leg 102, from about one-third to about one-eighth the length of the first pant leg 102, or from about one-fourth to about one-sixth the length of the first pant leg 102. The length of the pant leg is generally defined relative to the inseam length, as shown in FIG. 7.

As shown in FIG. 8, the first textile boundary 136 may extend from a first point 140 at the distal edge 130 to the first free fabric edge 132. The first point 140 may be located at the distal edge 130 at the side or the rear of the lower-torso garment 100, in an aspect. In various aspects, the first point 140 is located within about 20 cm of a first intersection location 141 where the first free fabric edge 132 meets the first pant leg 102 distal edge 130. The first free fabric edge 132 meets the distal edge 130 at the first intersection location 141 and the first intersection location 141 forms a first interior angle 142. In various aspects, the first interior angle 142 may be greater than, equal to, or less than 90 degrees. As shown in FIG. 9, the second textile boundary 138 may extend from a second point 144 at the distal edge 130 to the second free fabric edge 134. The second point 144 may be located at the distal edge 130, and positioned at the front or the side of the lower-torso garment 100. In various aspects, the second point 144 is located within about 20 cm of a second intersection location 143 where the second free fabric edge 134 meets the distal edge 130. The second free fabric edge 134 meets the distal edge 130 and forms a second interior angle 146. In various aspects, the second interior angle 146 may be greater than, equal to, or less than 90 degrees.

Turning back to FIG. 7, the first pant leg 102 micro hook-and-loop closure system 114 may be transitioned to a first in-use configuration (e.g., open) by pulling the second free fabric edge 134 of the second textile 120 away from the first textile 118 and freeing the second textile 120 from the first textile 118, in one aspect. The first pant leg 102 micro hook-and-loop closure system 114 may be transitioned to a second in-use configuration (e.g., closed state) by placing at least a portion of the second textile 120 in contact with the first textile 118. In a further aspect, the second free fabric edge 134 may also be placed in contact with at least a portion of the first textile 118. For example, the second free fabric edge 134 may be placed in contact with at least a portion of the first textile 118 along a portion, or all, of the length of the second free fabric edge 134. In another example, the second textile 120 and the second free fabric edge 134 may also be placed in contact with at least a portion of the first textile 118 along a portion, or all, of the length of the second free fabric edge 134. In one aspect, the second free fabric edge 134 may be placed in contact with the first textile 118, thereby causing the second textile 120 to contact and releasably mate with the first textile 118.

The size of the areas of contact between the first textile 118 and the second textile 120 may vary, as should be apparent from a comparison of the example perimeter shapes of the first textile 118 and the second textile 120, for example, as depicted in in FIGS. 8 and 9. In some aspects, the first textile 118 may have a larger surface area than the second textile 120. For example, when the dimensions of the first textile 118 are larger in length and width relative to the second textile 120, the second textile 120 may be placed in contact with varying amounts of the surface area of the first textile 118 due to the larger dimensions of the first textile 118 enabling many areas of contact (e.g., increasing the amount of contact or decreasing the amount of contact between the first and second textiles 118 and 120). For example, the closer the second free fabric edge 134 is placed in relation to the first textile boundary 136 in the second in-use configuration, the tighter the fit of the first pant leg 102 distal end 108 of the lower-torso garment 100. In the same vein, the farther the second free fabric edge 134 is placed in relation to the first textile boundary 136 in the second in-use configuration, the looser the 'wrap' fit of the first pant leg 102 distal end 108 of the lower-torso garment 100. Moreover, as the size of the contact areas between the second textile 120 and the first textile 118 increases, the textile-to-textile adherence of the closure of the micro hook-and-loop closure system 114 may increase. As the textile-to-textile adherence is increased, the secureness of the second in-use configuration also increases (e.g., as the size of the contact areas between the second textile 120 and the first textile 118 increases, the pant leg is securely held in the second in-use configuration and more force is needed to transition to the first in-use configuration).

In one aspect, the second textile 120 is configured to contact and releasably mate with the entirety of the first textile 118 when in the second is-use configuration. In another aspect, the second textile 120 is configured to contact and releasably mate with only a portion of the surface area of the first textile 118 when in the second in-use configuration. In one such aspect, a portion of the surface area of the first textile 118 remains uncoupled from the second textile 120 and exposed at the outer-facing surface 122 of the lower-torso garment 100. For example, the second textile 120 might contact about 75% or less of the surface area of the first textile 118 when in the second in-use configuration. In another example, the second textile 120 might contact about 75% or more of the surface of the first textile 118 when in the second in-use configuration. In various aspects, the second textile 120 may contact and be releasably mated with at least about 60%, 70%, 80%, 90%, and 95% or more of a surface area of the first textile 118 located on the outer-facing surface 122.

Figure 10:
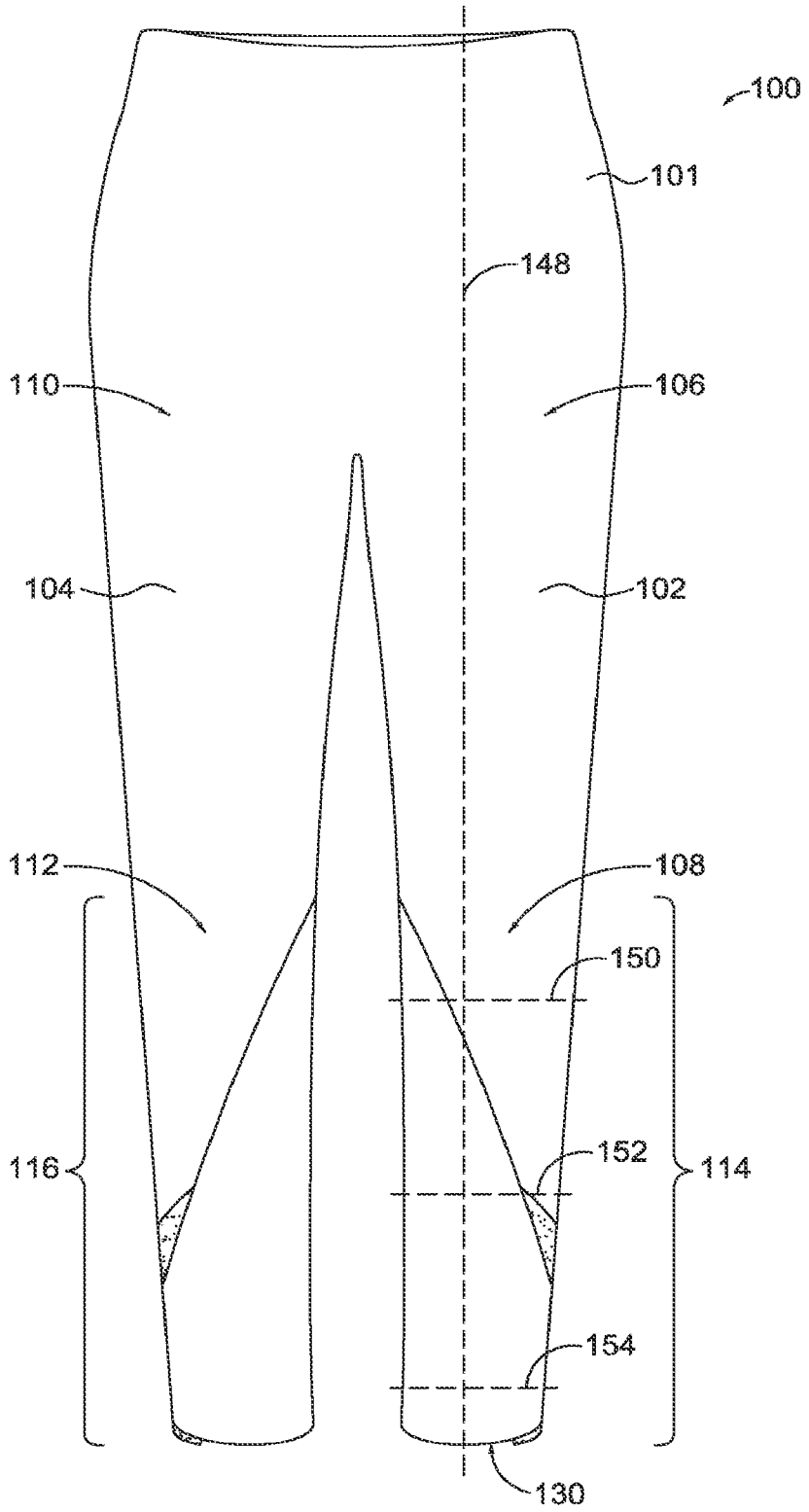
FIG. 10 depicts a front view of the lower-torso garment of FIG. 1, in accordance with an aspect herein.
Figures 11, 12, 13:
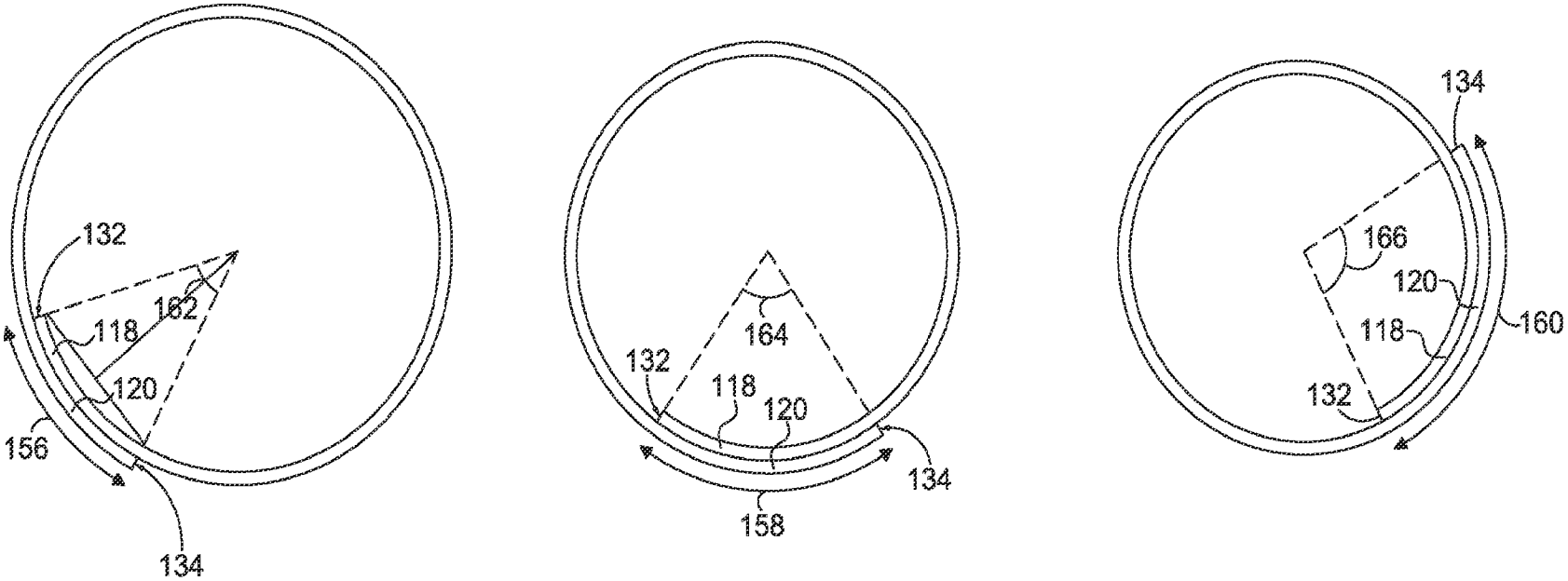
FIG. 11 depicts a first cross-section of a leg portion of the lower-torso garment of FIG. 1 taken at a first level as indicated in FIG. 10, in accordance with an aspect herein.
FIG. 12 depicts a second cross-section of the leg portion of the lower-torso garment of FIG. 1 taken at a second level as indicated in FIG. 10, in accordance with an aspect herein.
FIG. 13 depicts a third cross-section of the leg portion of the lower-torso garment of FIG. 1 taken at a third level as indicated in FIG. 10, in accordance with an aspect herein.

The amount of surface area contact between the second textile 120 and the first textile 118 may vary along a hypothetical vertical axis 148 that generally corresponds to the first pant leg 102, shown in FIG. 10. Three cross-sections taken along the hypothetical vertical axis 148 are shown in FIGS. 11, 12, and 13, presenting the micro hook-and-loop closure system 114 in the second in-use configuration. In FIG. 11, a first horizontal cross-section 150 is shown. The illustrative first horizontal cross-section 150 is located nearer the proximal end 106 than the distal edge 130, relative to a second horizontal cross-section 152 shown in FIG. 12. The illustrative second horizontal cross-section 152 is located nearer the proximal end 106 than the distal edge 130, relative to a third horizontal cross-section 154 shown in FIG. 13. As shown by the illustrative first horizontal cross-section 150, the second textile 120 contacts a first area of the first textile 118, in one aspect. As shown by the illustrative second horizontal cross-section 152, the second textile 120 contacts a second area of the first textile 118. As shown by the illustrative third horizontal cross-section 154, the second textile 120 contacts a third area of the first textile 118. In aspects, a first width 156 of the contact area shown in the first horizontal cross-section 150 is less than a second width 158 of the contact area shown in the second horizontal cross-section 152. In a further aspect, the second width 158 of the contact area shown in the second horizontal cross-section 152 is less than a third width 160 of the contact area shown in the third horizontal cross-section 154. In such aspects, as the width of the second textile 120 and the width of the first textile 118 increase nearer the distal edge 130, the contact area (e.g., as shown by the example widths in FIGS. 11, 12, and 13) between the second textile 120 and the first textile 118 also increases nearer the distal edge 130. As the contact areas between the second textile 120 and the first textile 118 increase nearer the distal edge 130, and/or as the hypothetical vertical axis 148 nears the distal edge 130, the textile-to-textile adherence of the closure of the micro hook-and-loop closure system 114 may increase due to the increased adhesion area. Generally speaking, a contact area refers to the surface area determined from the dimensions and shape of an area of the second textile 120 that is releasably mated with the first textile 118. In some aspects, only a portion of the second textile 120 releasably mates with only a portion of the first textile 118, such that the contact area may not be the same dimensions and/or shape as either of the first textile 118 or the second textile 120.

In various aspects, the widths of the contact areas bear a ratio to the circumference of the first pant leg 102, depending on their location relative to the distal edge 130. In aspects, the first width 156 of the contact areas shown in the first horizontal cross-section 150 may be from about one-tenth to about one-sixth of the total circumference of the first pant leg 102 measured at the first horizontal cross-section 150. In another aspect, the second width 158 of the contact areas shown in the second horizontal cross-section 152 may be from about one-sixth to about one-third of the total circumference of the first pant leg 102 measured at the first horizontal cross-section 150. In yet another aspect, the third width 160 of the contact areas shown in the third horizontal cross-section 154 may be from about one-third to about three-fourths of the total circumference of the first pant leg 102 measured at the first horizontal cross-section 150. These are example ratios and should not be construed as limiting.

The differences between the contact areas may be described using an angle, for example. For example, in one aspect, a first contact area angle 162 is shown with regard to the first horizontal cross-section 150. The first contact area angle 162 is measured from a first point of contact between the second free fabric edge 134 of the second textile 120 and the first textile 118, to a last point of contact between the first free fabric edge 132 of the first textile 118 and the second textile 120. The "last point of contact" generally refers to an edge or an area directly proximate to an edge of a contact area between two complementary materials, the edge of the contact area referring to an area wherein the micro hook or micro loop materials transition from engagement to disengagement with one another. The first contact area angle 162 is a measurement of the angle between these points of contact viewed at the first horizontal cross-section 150, about the hypothetical vertical axis 148. The second contact area angle 164 is measured from a first point of contact between the second free fabric edge 134 of the second textile 120 and the first textile 118, to a last point of contact between the first free fabric edge 132 of the first textile 118 and the second textile 120. The second contact area angle 164 is a measurement of the angle between these points of contact viewed at the second horizontal cross-section 152, about the hypothetical vertical axis 148. The third contact area angle 166 is measured from a first point of contact between the second free fabric edge 134 of the second textile 120 and the first textile 118, to a last point of contact between the first free fabric edge 132 of the first textile 118 and the second textile 120. The third contact area angle 166 is a measurement of the angle between these points of contact viewed at the third horizontal cross-section 154, about the hypothetical vertical axis 148. Thus, the first contact area angle 162, the second contact area angle 164, and the third contact area angle 166 are measurements taken at different points along the hypothetical vertical axis 148 relative to the distal edge 130. The third contact area angle 166 may be greater than the first contact area angle 162 and/or the second contact area angle 164, in some aspects. In one aspect, the second contact area angle 164 may be greater than the first contact area angle 162.

It should be noted that while the micro hook and/or micro loop materials of the first textile 118 and the second textile 120 are shown as providing continuous or uninterrupted coverage in FIGS. 11, 12, and 13, for example, the micro hook and micro loop materials may provide interrupted coverage of the respective textiles in some aspects. For example, the micro hook and micro loop materials of the textiles may form one or more of a pattern, a design, a logo, a word, a number, or a shape that comprises or covers less than 100% of each respective textile. In such aspects, the first textile 118 and the second 120 textile may comprise the same, similar, or different pattern, design, logo, word, number, or shape so long as the same, similar, or different pattern of the second textile 120 contacts at least about 60% of the design, logo, word, number, or shape of the first textile 118 when the micro hook-and-loop closure system 114 is in the second in-use configuration to ensure an adequate contact area for adhesion.

Figure 14:
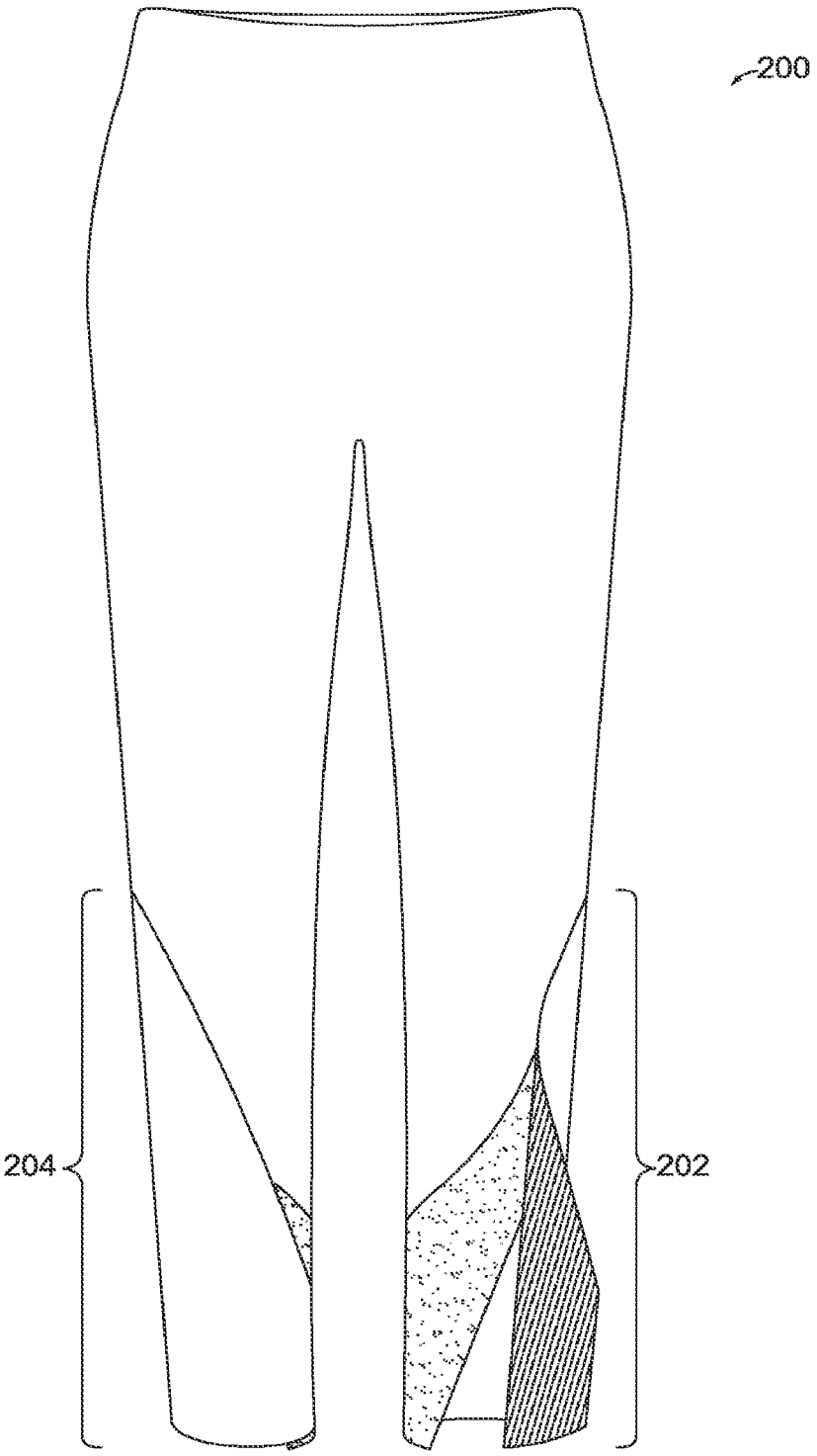
FIG. 14 depicts a lower-torso garment having at least one micro hook-and-loop closure system of an alternative configuration, in accordance with an aspect herein.

FIG. 14 depicts a second lower-torso garment 200 having an alternative configuration than the lower-torso garment shown in FIG. 1. As shown in FIG. 14, the second lower-torso garment 200 comprises pant legs and micro hook-and-loop closure systems 202 and 204 that are similar to those discussed above with regard to FIG. 1. However, the alternative configuration of the micro hook-and-loop closure systems 202 and 204 may be placed into the first in-use configuration (e.g., open state) by pulling a portion of a pant leg micro hook-and-loop closure system in a counterclockwise direction in order to free textiles comprising micro hook and micro loop materials from one another as previously described. Similarly, the micro hook-and-loop closure systems 202 and 204 may be placed into the second in-use configuration (e.g., closed state) by pulling a portion of the micro hook-and-loop closure system in a clockwise direction and placing textiles in contact with one another. Thus, the principles of operation of the micro hook-and-loop closure systems of FIG. 14 are similar to those discussed above with regard to the lower-torso garment of FIG. 1, but for the direction of the wrap-type operation. Due to the similarities that will be understood from this Detailed Description, details of the micro hook-and-loop closure systems 202 and 204 are apparent and are not discussed further herein for brevity.

Figure 15:
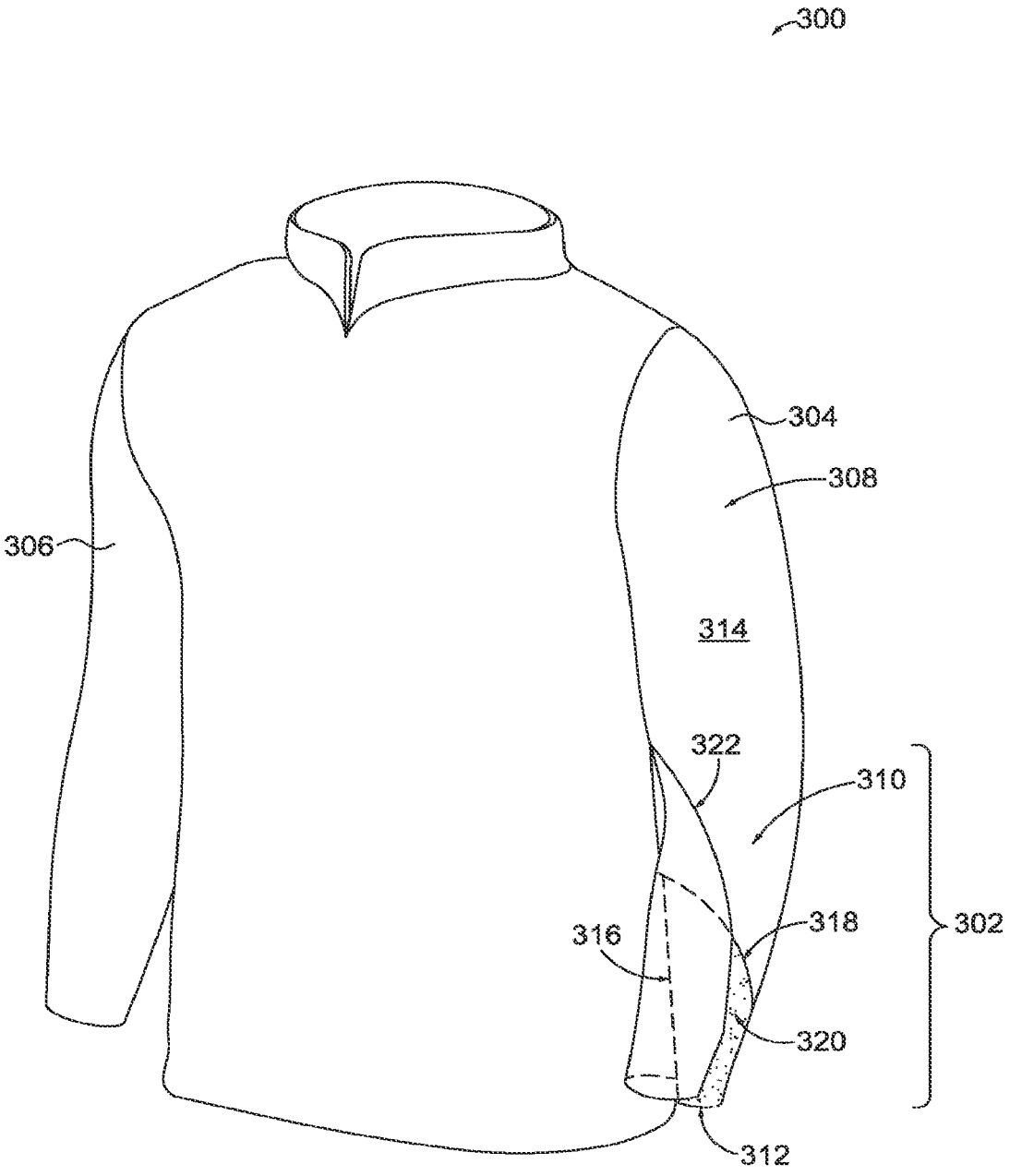
FIG. 15 depicts a perspective view of an upper-body garment having at least one micro hook-and-loop closure system, in accordance with an aspect herein.
Figure 16:
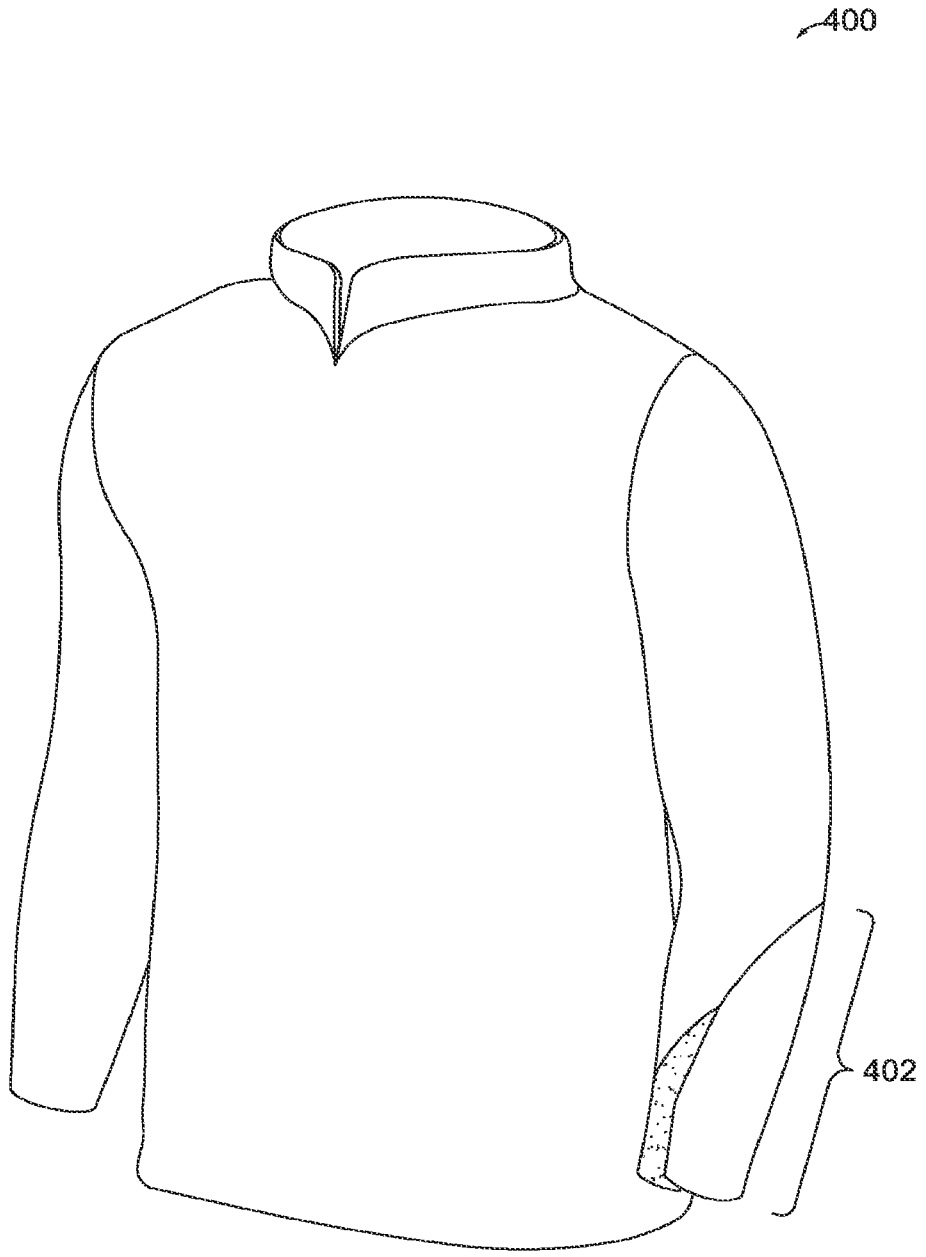
FIG. 16 depicts a perspective view of an upper-body garment having at least one micro hook-and-loop closure system of an alternative configuration, in accordance with an aspect herein.

FIGS. 15 and 16 depict a first upper-body garment 300 and a second upper-body garment 400 respectively. Each of the first upper-body garment 300 and the second upper-body garment 400 have at least one micro hook-and-loop closure system, such as micro hook-and-loop closure system 302 or 402, respectively. The first upper-body garment 300 comprises at least one sleeve. In aspects, the first upper-body garment 300 comprises a first sleeve 304 and a second sleeve 306. The first sleeve 304 comprises a proximal end 308, a distal end 310, and a distal edge 312. The first sleeve 304 further comprises an inner-facing surface (not visible in FIG. 15) and an outer-facing surface 314. The micro hook-and-loop closure system 302 of the first sleeve 304 comprises a first textile 320 located on the outer-facing surface 314 and a second textile located on the inner-facing surface. The first textile 320 is located at or near the distal edge 312 of the first sleeve 304. The first textile 320 has a perimeter shape that is bounded by a first free fabric edge 316 (e.g., dotted line(s) indicate locations of first free fabric edge 316) and a first textile boundary 318. The first textile 320 comprises one of a micro hook or micro loop material. The second textile is also located adjacent to the distal edge 312 of the first sleeve 304. The second textile has a perimeter shape that is at least bounded by a second free fabric edge 322 and a second textile boundary (not visible in FIG. 15). The second textile comprises one of a micro hook or micro loop material that is complementary to the first textile 320. The second textile is configured to overlap and contact the first textile 320, thereby releasably mating with the first textile 320 when in the second in-use configuration. Other aspects of the first textile 320 and the second textile will be apparent based on the prior discussions of the other micro hook-and-loop closure systems herein.

The micro hook-and-loop closure system 402 of the second upper-body garment 400 of FIG. 16 has a configuration that is different than the first upper-body garment 300 of FIG. 15. It will be apparent that the principles of operation are similar to those discussed above with regard to the lower-torso garment of FIG. 1, but for the direction of the wrap-type operation in each of the upper-body garments.

The disclosure provided above is intended to illustrate some possible combinations of various aspects associated with micro hook-and-loop closure systems. Those skilled in the art will understand, however, that within each aspect, some features may be optional. Moreover, different features discussed in different aspects could be combined in still other aspects and would still fall within the scope of the attached claims. Some features could be used independently in some aspects, while still other features could be combined in various different ways in still other aspects. The purpose served by the disclosure, however, is to provide an example of the various features and concepts related to the aspects described herein, not to limit the scope thereof. One skilled in the relevant art will recognize that numerous variations and modifications may be made to the configurations described above without departing from the scope of aspects described herein, as defined by the claims.

The present disclosure may also be described in accordance with the following numbered clauses:

Clause 1. A garment comprising: at least one extremity-covering portion having a proximal end, a distal end, an inner-facing surface, and an outer-facing surface, the distal end of the extremity-covering portion comprising: a first free fabric edge extending towards the proximal end of the at least one extremity-covering portion, a second free fabric edge extending towards the proximal end of the at least one extremity-covering portion, a first textile comprising one of a micro hook material or a micro loop material located on the outer-facing surface of the distal end of the at least one extremity-covering portion adjacent to the first free fabric edge, and a second textile comprising one of a micro hook material or a micro loop material complementary to the micro hook material or the micro loop material of the first textile, the second textile located on the inner-facing surface of the distal end of the at least one extremity-covering portion adjacent to the second free fabric edge.

Clause 2. The garment of clause 1, wherein the micro hook material comprises micro-fibriform pile structures having a denier of about 10 denier or less.

Clause 3. The garment of clause 1, wherein the micro loop material comprises micro-fibriform loop structures having a denier of about 10 denier or less.

Clause 4. The garment of clause 1, wherein the second textile is configured to releasably mate with at least a portion of the first textile.

Clause 5. A lower-torso garment comprising: at least one pant leg having a proximal end, a distal end, an inner-facing surface, and an outer-facing surface, the distal end of the at least one pant leg comprising: a first free fabric edge extending towards the proximal end of the pant leg, a second free fabric edge extending towards the proximal end of the at least one pant leg, a first textile comprising one of a micro hook material or a micro loop material, the first textile located on the outer-facing surface of the distal end of the at least one pant leg adjacent to the first free fabric edge, and a second textile comprising one of a micro hook material or a micro loop material complementary to the micro hook material or the micro loop material of the first textile, the second textile located on the inner-facing surface of the distal end of the at least one pant leg adjacent to the second free fabric edge; wherein the second textile is configured to releasably mate with at least a portion of the first textile.

Clause 6. The lower-torso garment of clause 5, wherein the second textile is configured to releasably mate with an entirety of the one of the micro hook material or the micro loop material of the first textile.

Clause 7. The lower-torso garment of clause 5, wherein in a first in-use configuration, the second textile is not mated with the first textile, and wherein in a second in-use configuration, the second textile is releasably mated with at least 50% of a surface area of the first textile.

Clause 8. The lower-torso garment of clause 7, wherein in the second in-use configuration, at least a portion of the first textile is not releasably mated with the second textile.

Clause 9. The lower-torso garment of clause 5, wherein in a second in-use configuration, the second textile is configured to releasably mate with at least 75% of a surface area of the first textile.

Clause 10. The lower-torso garment of clause 9, wherein in the second in-use configuration, only a portion of the first textile is releasably mated with the second textile.

Clause 11. The lower-torso garment of clause 5, further comprising a distal edge and a first textile boundary, wherein a width of the first textile measured from the first free fabric edge to the first textile boundary increases as the first textile boundary extends distally toward the distal edge.

Clause 12. The lower-torso garment of clause 5, further comprising a distal edge and a second textile boundary, wherein a width of the second textile measured from the second free fabric edge to the second textile boundary increases as the second textile boundary extends distally toward the distal edge.

Clause 13. The lower-torso garment of clause 5, wherein the micro hook material has micro-fibriform pile structures having a denier of about 10 denier or less and wherein the micro loop materials are micro-fibriform loop structures having a denier of about 10 denier or less.

Clause 14. The lower-torso garment of clause 5, wherein the micro hook material has a fiber diameter of about 10 microns and a fiber cross-section of about 80 square microns.

Clause 15. The lower-torso garment of clause 5, wherein the micro loop material has a fiber diameter of about 3 microns and a fiber cross-section of about 8 square microns.

Clause 16. An upper-body garment comprising: at least one sleeve having a proximal end, a distal end, an inner-facing surface, and an outer-facing surface, the distal end of the sleeve comprising: a first free fabric edge extending towards the proximal end of the at least one sleeve, a second free fabric edge extending towards the proximal end of the sleeve, a first textile comprising one of a micro hook material or a micro loop material, the first textile located on the outer-facing surface of the distal end of the at least one sleeve adjacent to the first free fabric edge, and a second textile comprising one of a micro hook material or a micro loop material complementary to the micro hook material or the micro loop material of the first textile, the second textile located on the inner-facing surface of the distal end of the at least one sleeve adjacent to the second free fabric edge; wherein the second textile is configured to releasably mate with at least a portion of the first textile.

Clause 17. The upper-body garment of clause 16, wherein in a first in-use configuration, the second textile is not mated with the first textile.

Clause 18. The upper-body garment of clause 16, wherein in a second in-use configuration, the second textile is releasably mated with at least 50% of a surface area of the first textile.

Clause 19. The upper-body garment of clause 16, wherein in a second in-use configuration, the second textile is configured to releasably mate with at least 75% of a surface area of the first textile.

Clause 20. The upper-body garment of clause 19, wherein in the second in-use configuration, only a portion of the first textile is releasably mated with the second textile.

What is claimed is:

1. An upper-body garment comprising:

at least one sleeve having a proximal end, a distal end, an inner-facing surface, and an outer-facing surface, the distal end of the at least one sleeve comprising:

a first free fabric edge extending towards the proximal end of the at least one sleeve;

a second free fabric edge extending towards the proximal end of the at least one sleeve;

a first textile comprising a first material, the first textile located on the outer-facing surface of the distal end of the at least one sleeve adjacent to the first free fabric edge, the first textile further comprising a distal edge and a first textile boundary, wherein a width of the first textile measured from the first free fabric edge to the first textile boundary gradually continues to increase as the first textile boundary extends distally from the first free fabric edge toward the distal edge of the first textile; and a second textile comprising a second material, the second textile located on the inner-facing surface of the distal end of the at least one sleeve adjacent to the second free fabric edge;

wherein the second textile is configured to releasably mate with at least a portion of the first textile, and wherein the first and second materials are complementary micro hook and loop materials.

2. The upper-body garment of claim 1, wherein in a first in-use configuration, the second textile is not mated with the first textile.

3. The upper-body garment of claim 2, wherein in a second in-use configuration, the second textile is releasably mated with at least 50% of a surface area of the first textile.

4. The upper-body garment of claim 2, wherein in a second in-use configuration, the second textile is configured to releasably mate with at least 75% of a surface area of the first textile.

5. The upper-body garment of claim 2, wherein in a second in-use configuration, only a portion of the first textile is releasably mated with the second textile.

6. The upper-body garment of claim 1, wherein the complementary micro hook and loop materials comprise a micro hook material, and wherein the micro hook material comprises micro-fibriform pile structures having a denier of 10 denier or less.

7. The upper-body garment of claim 6, wherein the complementary micro hook and loop materials comprise a micro loop material, and wherein the micro loop material comprises micro-fibriform loop structures having a denier of 10 denier or less.

8. The upper-body garment of claim 1, further comprising a distal edge and a second textile boundary, wherein a width of the second textile measured from the second free fabric edge to the second textile boundary increases as the second textile boundary extends distally toward the distal edge.

9. The upper-body garment of claim 1, wherein the micro hook material has a fiber diameter of about 10 microns and a fiber cross-section of about 80 square microns, and wherein the micro loop material has a fiber diameter of about 3 microns and a fiber cross-section of about 8 square microns.

10. A method of forming an upper-body garment, the method comprising:

positioning a first material on an outer-facing surface of a sleeve of the upper-body garment (i) to be adjacent a distal end of the sleeve of the upper-body garment, (ii) to be adjacent a first free fabric edge extending toward a proximal end of the sleeve of the upper-body garment, a width of the first material measured from the first free fabric edge to a first boundary that gradually continues to increase as the first boundary extends from the first free fabric edge toward the distal end of the sleeve of the upper-body garment; and positioning a second material on an inner-facing surface of the sleeve of the upper-body garment (i) to be adjacent the distal end of the sleeve of the upper-body garment, (ii) to be adjacent a second free fabric edge extending toward the proximal end of the sleeve of the upper-body garment, wherein the first and second materials are complementary micro hook and loop materials.

* * * * *